US005732915A

United States Patent [19]

Heard

[11] Patent Number: 5,732,915

[45] Date of Patent: Mar. 31, 1998

[54] UNITARY SADDLE-TYPE BASE MOUNT FOR ATTACHING CHANNEL SECTION TO CYLINDRICAL ARTICLE

[75] Inventor: Robert Arthur Henderson Heard, Bristol, United Kingdom

[73] Assignee: Signfix Limited, Bristol, United Kingdom

[21] Appl. No.: 624,602

[22] PCT Filed: Oct. 19, 1994

[86] PCT No.: PCT/GB94/02283

§ 371 Date: Apr. 16, 1996

§ 102(e) Date: Apr. 16, 1996

[87] PCT Pub. No.: WO95/11505

PCT Pub. Date: Apr. 27, 1995

[30] Foreign Application Priority Data

Oct. 21, 1993 [GB] United Kingdom ..... 9321748
Feb. 8, 1994 [GB] United Kingdom ..... 9402431

[51] Int. Cl.[6] ..... G09F 7/18

[52] U.S. Cl. ..... 248/219.4; 248/218.4; 248/230.1; 248/230.8; 40/607; 403/331; 403/353

[58] Field of Search ..... 248/218.4, 219.4, 248/230.8, 230.1, 219.3, 223.41, 225.11; 403/381, 353, 294, 331

[56] References Cited

U.S. PATENT DOCUMENTS

| | | | |
|---|---|---|---|
| 3,341,959 | 9/1967 | Sabadics | 40/607 |
| 3,894,707 | 7/1975 | Heard | 248/225.11 X |
| 4,066,233 | 1/1978 | Heard | 248/225.11 X |
| 4,211,381 | 7/1980 | Heard | 248/230.8 |
| 4,341,029 | 7/1982 | Heard | 248/230.8 X |
| 4,801,115 | 1/1989 | Heard | 248/219.4 X |
| 4,860,985 | 8/1989 | Olson et al. | 248/219.4 X |
| 5,098,054 | 3/1992 | Dyer | 248/225.11 X |
| 5,590,504 | 1/1997 | Heard et al. | 248/218.4 X |

*Primary Examiner*—Derek J. Berger
*Assistant Examiner*—Donald J. Wallace
*Attorney, Agent, or Firm*—Larson & Taylor

[57] ABSTRACT

A mounting device (2) for securing a sign to a post (46) is disclosed comprising: (a) a saddle portion having a pair of opposite side members (4) of similar form and spaced apart, the side members being adapted to seat against a post (46); (b) a base element (6) joining and spacing apart the side members (4), the base element (6) having a narrower neck portion (7) extending away from the post and connected to an enlarged abutment portion (3), the neck portion (7) being adapted to allow the abutment portion (3) to pass slideably into a channel (32) attached to the sign, the channel having a mouth with inturned lips to retain the abutment portion (3) in the channel; and (c) a pair of attachment members (8) held at opposite ends of the saddle portion and connectable to the post by strapping passed around the post, wherein the attachment members (8) have stem portions (25) connected to the abutment portion. Preferably, the mounting device (2) is made from a single component, e.g. folded from a sheet metal blank. Optionally, it is provided with teeth (50) or other means to enhance the fit between the device (2) and the channel (32).

20 Claims, 4 Drawing Sheets

UNITARY SADDLE-TYPE BASE MOUNT FOR ATTACHING CHANNEL SECTION TO CYLINDRICAL ARTICLE

FIELD OF THE INVENTION

The present invention relates to mounting devices, and more particularly to mounting devices for use in securing an object, such as a sign, to a post.

BACKGROUND OF THE INVENTION

In an earlier patent, GB 1533412, a mounting device is disclosed comprising a saddle having a pair of opposite side members having shaped portions to seat against a post and a pair of separate attachment members loosely carried at opposite ends of the saddle between the two side members. Each attachment member is provided with a stem portion having enlarged ends and projecting beyond the saddle in a direction remote from the shaped portions of the side members, and a slotted portion. The rear of the object to be secured to the post is provided with a channel having a mouth with inturned lips.

In use, the object is attached to the post by engaging the enlarged ends of the attachment members with the inturned lips of the channel and passing strapping through the slots in their body portions. Tightening the strapping around the post draws the saddle against it and forces the enlarged ends of the attachment members to tightly grip the lips of the channel, thereby fixing the sign to the post.

Another patent, GB 2021390, discloses a similar mounting device for securing offset signs to posts in which the stem portions of the attachment members are joined together on a base, the base having a bracket to which the edge of the offset sign can be secured.

However, both of the above mounting devices are composed of a plurality of parts, with the result that they can be expensive to manufacture and assemble.

SUMMARY OF THE INVENTION

Broadly, the present invention concerns a unitary mounting device which provides a saddle portion having a post abutment face and a portion for enabling the device to be mounted to a narrow-mouthed channel, said portion including a neck-portion extending away from the saddle portion remote from the post abutment face, and an enlarged head portion. The unitary device may further include attachment means for engaging strapping for securing the device a post in contact with the post abutment face. Preferably, the unitary device is formed by folding a blank of sheet metal.

The present invention also concerns modifications to the above mounting devices to enhance the engagement between the narrow-mouthed channel attached to the object and the device.

In one preferred form, the present invention provides a mounting device for securing a sign to a post comprising:

(a) a saddle portion having a pair of opposite side members of similar form and spaced apart, the side members being adapted to seat against a post;

(b) a base element joining and spacing apart the side members, the base element having a narrower neck portion extending away from the post and connected to an enlarged abutment portion, the neck portion being adapted to allow the abutment portion to pass slideably into a channel attached to the sign, the channel having a mouth with inturned lips to retain the abutment portion in the channel; and, (c) a pair of attachment members held at opposite ends of the saddle portion and connectable to the post by strapping passed around the post, wherein the attachment members have stem portions connected to the abutment portion.

Accordingly, the present invention provides a mounting device which is preferably made as a single component. Conveniently, it is made by folding a blank of sheet material, eg sheet stainless steel, into the shape described above. Alternatively, the mounting device could be cast as a single component, eg in aluminium.

Preferably, the abutment portion extends along the length of the mounting device, maximising the area of engagement with the lips of the channel. This has the advantage of making it harder for vandals to remove the object by prising open the lips of the channel.

In use, the mounting device may optionally deform slightly when the strapping is tightened to improve the fit with the post. In this type of embodiment, the attachment members may be additionally provided with ears extending from their sides and held approximately parallel to the longitudinal axis of the device. The ears limit the inward movement of the attachment members, moving to abut the surface of the post when the device is tightened. Advantageously, the ears may be swaged to strengthen them.

The mounting device and the channel may also be made of materials of different hardness so that one of the abutment portion and the inside of the lips of the channel will bite into the other, enhancing the engagement between the channel and the mounting device.

The engagement between the channel and the mounting device can also be enhanced by modifying the stem portions of the attachment members so that they increase in width towards the abutment portion providing edges which can bite into the lips of the channel when the strapping used to attach the mounting device to the post is tightened.

Alternatively or additionally, a face of the abutment portion can be provided with teeth adapted to bite into inside of the lips of the channel when the strapping is tightened around the post, thereby enhancing the engagement between the mounting device and the channel.

Preferably, teeth are provided towards the ends of the abutment portion where the attachment members are connected. However, in some embodiments, it may be useful to provide further teeth along the length of the abutment portion.

In use, it is found that when the mounting device is secured around a post by strapping, tightening the strapping causes the teeth to bite into the lips of the channel until the abutment portion itself comes into contact with the lips. This limits the extent to which the teeth will bite into the lips of the channel.

In a further aspect, the present invention discloses that it is possible to provide an insert for increasing the width of the abutment portion so that a mounting device can be adapted for use in channels having different width of mouth. Preferably, the insert takes the form of a substantially flat I-shaped member, eg pressed from stainless steel, the narrower central region of the I-shaped insert being adapted to pass between the sides of the neck portion of the base element so that the enlarged end regions of the I-shaped insert can overlie the abutment portion. The ends of the I-shaped member are laterally enlarged so that they overhang the abutment portion thereby increasing the width of the abutment portion of the base element.

BRIEF DESCRIPTION OF THE DRAWINGS

Some embodiments of the present invention will now be described with reference to the accompanying drawings in which.

DETAILED DESCRIPTION

Figure 1:
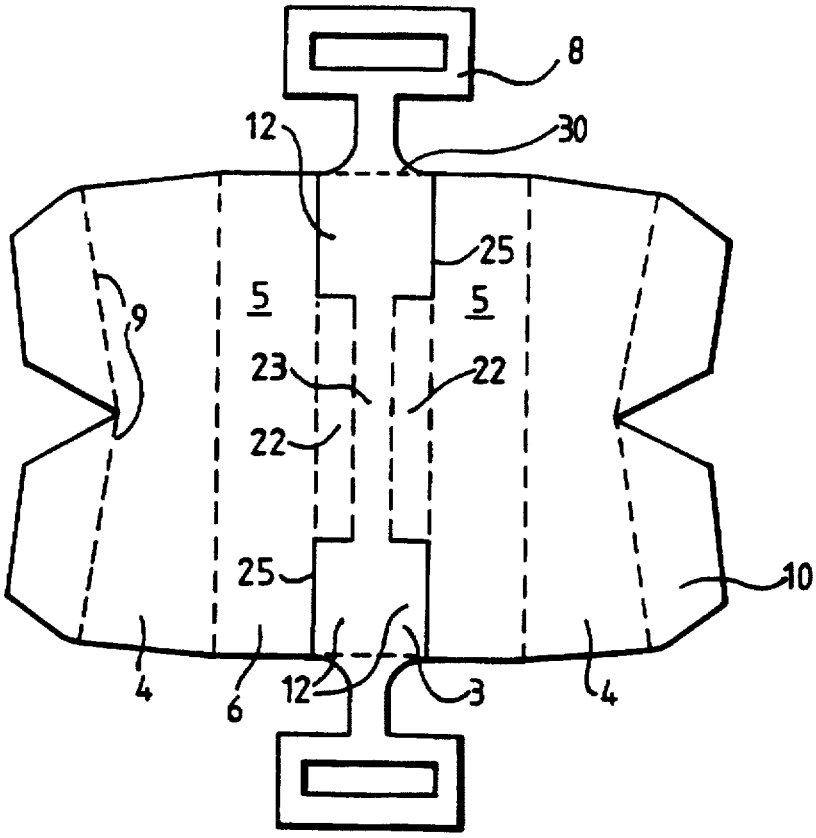
FIGS. 1 and 2 show plan views of two sheet metal blanks for forming into mounting devices which are first and second embodiments of the present invention, with dotted lines indicating fold lines.
Figure 2:
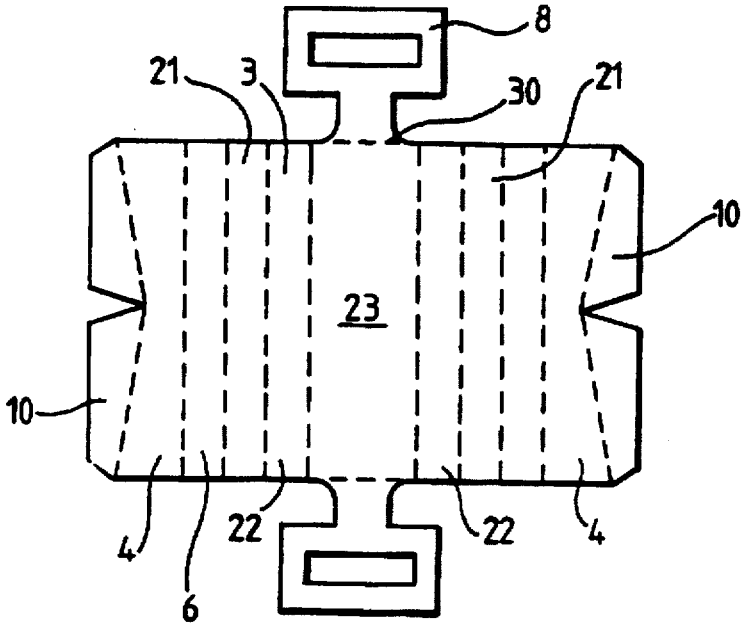

Referring to FIGS. 1 and 2, blanks may suitably be cut from sheet metal, eg aluminium or stainless steel. The dotted lines indicate where the blanks may be folded to produce a mounting device 2 (in the case of the FIG. 1 blank, after L-shaped cuts 25 have been made). The blanks have portions which form a pair of opposite side members 4, a base element 6, a neck 7 connecting the base element 6 to an abutment portion 3, and a pair of attachment members 8.

In the blank of FIG. 1, the base element 6 is formed from two base-forming panels 5 separated by panels forming the abutment portion 3. These latter comprise a pair of neck-forming panels 22 joined by an abutment forming panel 23. The abutment-forming panel is, by virtue of L-shaped cuts 25, laterally enlarged at its ends so as to provide abutment wings 12 (See FIG. 3) to engage under the lips 36 of the mouth of the channel 32. The attachment members 8 are joined no the ends of the abutment panel 23 by fold lines 30.

The side member forming panels 4 have shallow V-shaped edges, remote from the base element 6, defined by fold lines 9, dividing the panels 4 from flanges 10 which provide an enlarged area for seating against a supporting post.

The blank of FIG. 2 is essentially similar, except that the abutment panel 23 is rectangular in outline and is separated from the neck-forming panels 22 by auxiliary abutment panels 21.

Figure 3:
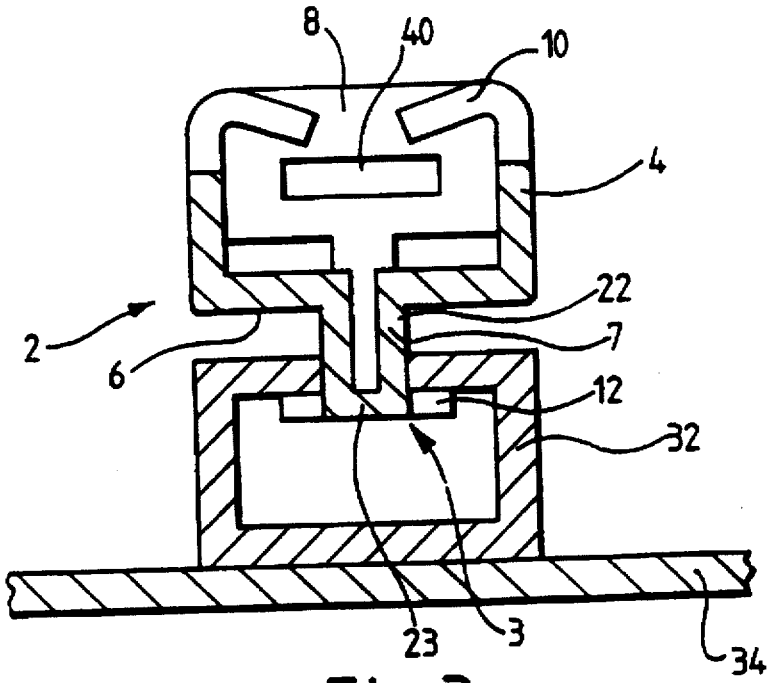
FIGS. 3 and 4 show cross-sections through the embodiments of mounting devices made from the blanks shown in FIGS. 1 and 2, when each mounting device has engaged a channel attached to a sign.
Figure 4:
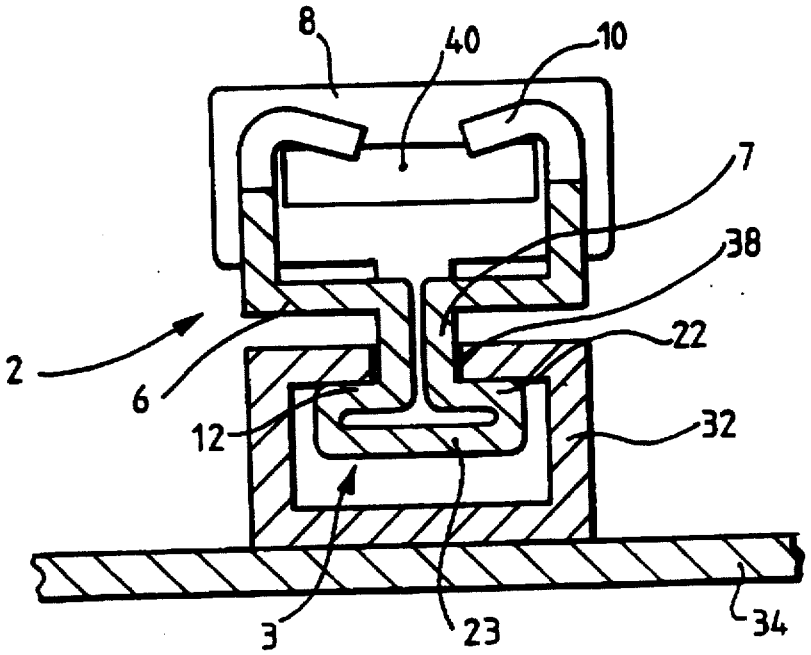

In FIGS. 1 and 2, the mounting device 2 is made by folding about the various fold lines into configurations shown in cross-section in FIGS. 3 and 4 respectively. The panels 22 (FIG. 1) or 21 (FIG. 2) form a neck 7 which extends through the mouth of the channel 32 (see FIGS. 3 and 4). The mounting device 2 is retained in the channel 32 by the wings 12 of the abutment portion.

The side members 4, together with the base forming panels 5, provide a saddle for seating against the surface of a post. Flanges 10 are folded inwards to a shallow V-shape, increasing the area of engagement between the mounting device and the post.

The attachment members 8 are folded upwards along line 30 so they lie at opposite ends of the saddle.

In the embodiment shown in FIGS. 1 and 3, the abutment portion wings 12 extend only partially along the length of the mounting device. In FIGS. 2 and 4, the mounting device has wings 12, formed from the superposition of panels 22, 23 and which extend along the length of the mounting device and will therefore be stronger. The area of abutment between the wings 12 and the channel 32 will typically depend on the size of the sign and the materials composing the mounting device and channel.

Figure 5:
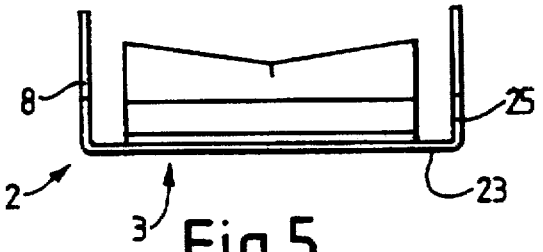
FIG. 5 shows a side elevation of the second embodiment.
Figure 6:
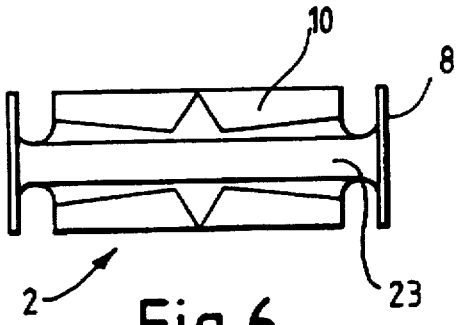
FIG. 6 shows a plan view of the second embodiment.

FIG. 5 shows a side elevation of the device of FIGS. 2 and 4 with attachment members 8 held at the ends of the saddle portion. The attachment members 8 are connected via stem portions 25 to the abutment panel 23. A plan view of this is shown in FIG. 6. This also shows the flanges 10 defining the V-shaped engagement surfaces of the saddle portion.

In use, the device may be attached to a post by passing strapping through slots 40 in the attachment members 8 and then around the post. The abutments can then be slid into the channel 32 attached to the rear of the sign. The neck 7 extends through the mouth of the channel. The mounting device is retained in the channel by the engagement of the wings 12 and the channel 32.

Tensioning the strap draws the attachment members 8 towards the post, thereby urging the wings 12 against the channel 32 and the V-shaped saddle against the post. Fastening the strapping then secures the sign to the post by friction.

Figure 7:
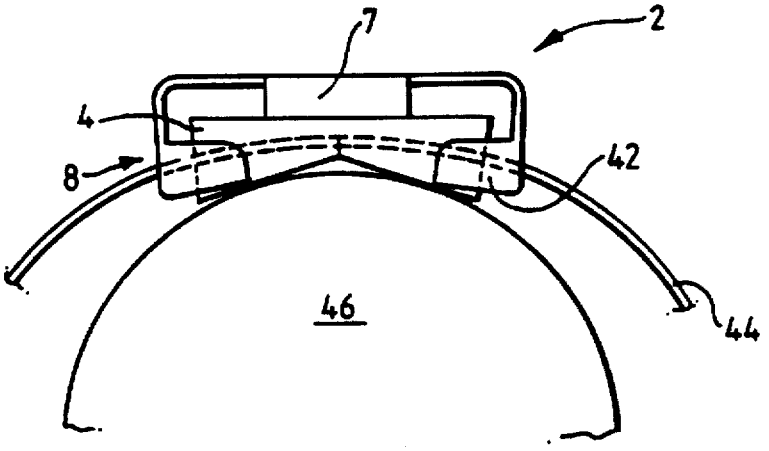
FIGS. 7 and 8 show a variant of the first embodiment having swaged ears in position around a post.
Figure 8:
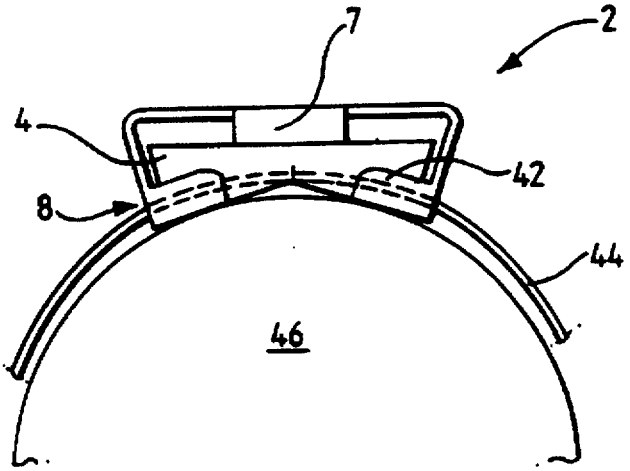

In the embodiment of the invention shown in FIGS. 7 and 8, the mounting device 2 has attachment members 8 provided with swaged ears 42 projecting from their sides approximately parallel to the longitudinal axis of the device. In this embodiment, the side portions 4 are cut back to allow the attachment members 8 to be drawn inwards when the strapping 44 used to attach the device is tightened.

In FIG. 7, the mounting device is located around a post 46 prior to tightening. The attachment members 8 are held adjacent to the ends of the saddle portion and strapping 44 passed through slots in the attachment members 8 and around the post.

When the strapping 44 is tightened (see FIG. 8), the attachment members 8 are drawn inwards until the swaged ears 42 abut the surface of the post 46. The V-shaped surface of the saddle portion and the abutment portion can also slightly deform to improve the fit between the device and the post prior to the swaged ears coming into contact with the post 46. However, the swaged ears 42 then help to prevent the device deforming further.

Figure 9:
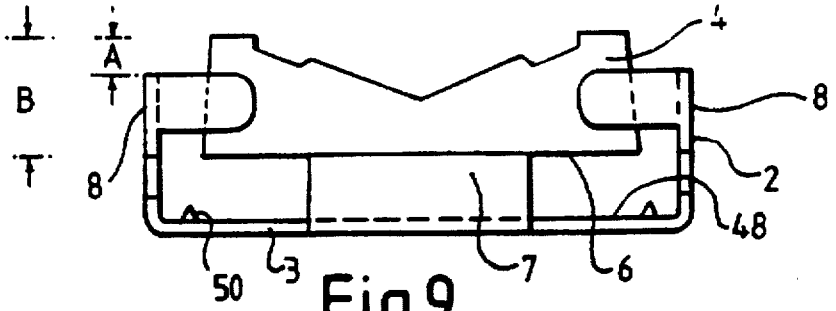
FIG. 9 shows a side view of a mounting device according to third embodiment with teeth provided on the abutment portion.
Figure 10:
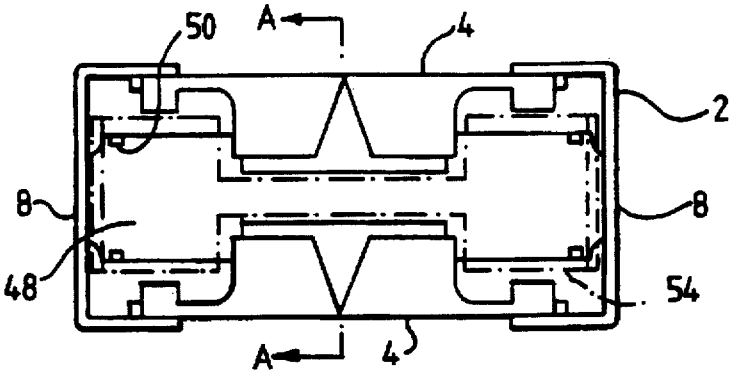
FIG. 10 shows a top view of the device of FIG. 9 with phantom lines showing the potential location of insert of FIGS. 13 and 14.

FIGS. 9 to 12 show a third embodiment of the invention. Referring to FIGS. 9 and 10, a mounting device 2 is generally as described in said copending application GB 9321748.7, and comprises a pair of opposite side members 4, a base element 6 and a neck 7, connecting the base element 6 to an abutment portion 3. A pair of attachment members 8 are connected to the ends of the abutment portion 3.

The side members 4 form a shallow V-shaped saddle for seating against a post. The mounting device 2 is attached to an object such as a sign by sliding the abutment portion 3 into a narrow mouthed channel having inturned lips. The neck 7 is able to fit through the mouth of the channel while the inturned lips retain the wider abutment portion 3. The mounting device 2 is secured to the post by passing strapping through slots 40 provided in the attachment members 8, flexing the strapping around the post and tightening and fastening it.

In FIGS. 9 and 10, the abutment portion 3 has a face 48 which in use abuts the inside of the lips of the channel. The face 48 is provided with teeth 50 towards its corners, the teeth 50 being adapted to bite into the channel lips when the strapping securing the mounting device 2 is tightened. This improves the engagement between the mounting device 2 and channel.

Figure 11:
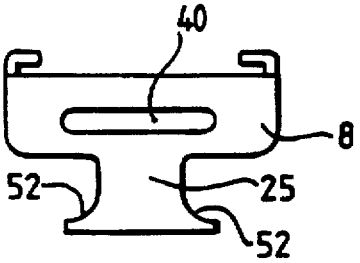
FIG. 11 shows an end view of the device of FIG. 9.
Figure 12:
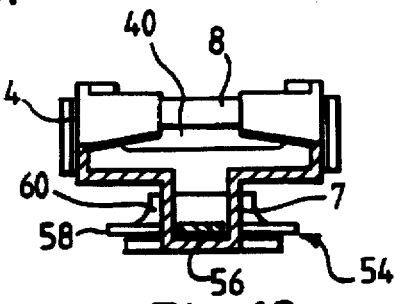
FIG. 12 shows a cross-section along line A—A in FIG. 10, including the inset of FIGS. 13 and 14.
Figure 13:
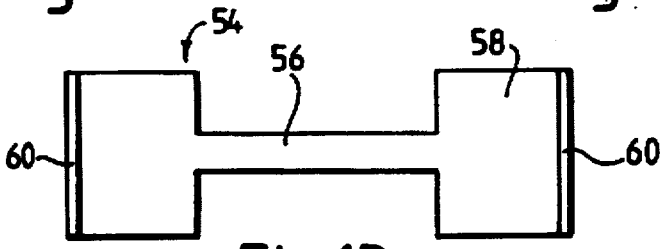
FIG. 13 shows an insert suitable for adapting the width of the abutment portion of the mounting device of FIGS. 9 and 10; and, FIG. 14 shows a side view of the insert of FIG. 13.
Figure 14:
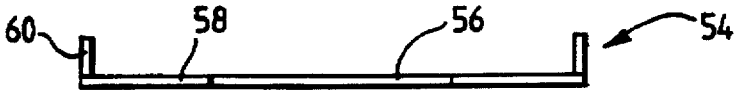

FIG. 11 shows an attachment member 8 generally similar to that of FIGS. 9 and 10, having a stem portion 25 connecting it to the abutment portion (not shown). The stem portion 25 increases in width towards the abutment portion 3 providing edges 52 which can cut into the lips of the channel when the strapping securing the mounting device is tightened.

As the stem portions 25 and teeth 50 are connected to the substantially flat abutment portion 3, they bite into the channel until the flat abutment portion 3 abuts the lips. This helps to prevent the stem portions 25 or teeth 50 cutting completely through the channel.

FIGS. 10 and 12 to 14 show an insert 54 for increasing the width of the abutment portion 3 so that the mounting device 2 can be adapted for us in channels having wider cross-section. The insert 54 is I-shaped having a narrow central region 56 and enlarged region 58.

The insert 54 locates on top of the abutment portion 3 as shown by the phantom lines in FIGS. 2 and cross-section in FIG. 4 with the central region 56 passing between the sides of the neck 7 connecting the base element 6 to the abutment portion 3. The end regions of the insert 54 are provided with small upturned tabs 60 to help centre it against the attachment members 8 and to provide edges which increase in width towards the abutment portion 3 in the same way as the edges 52 of FIG. 11. These edges can similarly bite into the lips of a channel when the strapping used to secure the device to a post is tightened. The insert 54 may also additionally or alternatively be provided with teeth, as shown on the abutment portion of FIGS. 9 and 10, to enhance the engagement between the insert 54 and the channel when the mounting device 2 is secured to a post.

As shown in FIG. 9, the topmost edge of the saddle side members 4 are spaced above the topmost edge of the attachment members 8 by a distance A and from the top of the slots 40 by a distance B. This has two effects when the saddle is used on a flat surface such as a rectangular post. Firstly, the provision of distance A allows the attachment members to be drawn towards the post by the tension in the strap, thereby ensuring a firm bite by the radiused corners 52 or teeth 50 into the channel lips. Secondly, the provision of distance B increases the distance from the slot 40 to the surface of the post, thereby increasing the angle which the strap makes with the surface of the (flat) post, and hence less tension is required in the strap to achieve a given pressure of the saddle against the post.

I claim:

1. A one-piece unitary mounting device which provides a saddle portion having a post-abutment face and a mounting portion for enabling the device to be mounted to a narrow-mouthed channel, said mounting portion comprising an abutment portion having two plate portions for insertion into the channel and for retention by the narrow mouth of said channel, the plate portions protruding outwardly beyond respective opposite ends of the saddle portion, a first, inner end of each plate portion being connected to the saddle portion by a neck portion extending away from the saddle portion remote from the post-abutment face to pass through said channel mouth to the abutment portion, and the other, outer end of each plate portion being connected to a respective stem portion for passing through the channel mouth and leading to a respective one of two enlarged attachment members for connection with a strap which is capable of being passed around a supporting post and tightened, and whereby the tightening of the strap around the supporting post causes a displacement of the attachment members towards the post.

2. A mounting device according to claim 1 wherein the attachment members are slotted to allow the attachment members to be connected to the strapping.

3. A mounting device according to claim 1 wherein the narrow mouth of the channel has lips, and the mounting device and the channel are made of materials of different hardness so that one of the abutment portion and the inside of the lips will bite in to the other to thereby enhance the engagement between the channel and the mounting device.

4. A mounting device according to claim 1 wherein the narrow mouth of the channel has lips, and the stem portions of the attachment members increase in width towards the abutment portion, thereby providing edges which are adapted to bite into the lips of the channel when the strapping used to attach the mounting device to the post is tightened.

5. A mounting device according to claim 1 wherein a face of the abutment portion is provided with teeth adapted to bite into the channel when the strapping is tightened around the post, to thereby enhance the engagement between the mounting device and the channel.

6. A mounting device according to claim 5 wherein the teeth are located towards the ends of the abutment portion.

7. A mounting device according to claim 1 further comprising an insert for increasing the width of the abutment portion, so that the mounting device can be adapted for use in channels of different width.

8. A mounting device according to claim 7 wherein the neck portion is formed as a generally U-shaped channel and the insert is I-shaped to provide enlarged end regions, wherein a narrower central region of the I-shaped insert is adapted to sit between the opposed sides of the U-shaped neck portion and the enlarged end regions of the I-shaped insert are adapted to overlie opposite end regions of the abutment portion, thereby to laterally enlarge the end regions.

9. A mounting device for securing a sign to a post comprising:

(a) a saddle portion having a pair of spaced apart opposite side members, the side members being adapted to seat against the post;

(b) a base element joining and spacing apart the side members, the base element having a narrower neck portion extending away from the post and being connected to an enlarged abutment portion, the neck portion being adapted to allow the abutment portion to pass slidably into a channel attached to the sign, the channel having a mouth with inturned lips to retain the abutment portion in the channel, and, (c) a pair of attachment members held at opposite ends of the saddle portion and connectable to the post by strapping passed around the post, wherein the attachment members have stem portions connected to the abutment portion;

said saddle portion, base element and attachment members being formed as a one-piece unitary part.

10. A mounting device according to claim 9 wherein the abutment portion extends along the length of the mounting device thereby maximizing the area of engagement between the mounting device and the lips of the channel.

11. A mounting device according to claim 9 wherein the device is capable of deforming when the strapping is tightened around the post.

12. A mounting device according to claim 9 wherein the attachment members have sides and are provided with ears extending from the sides of the attachment members and the attachment members are held approximately parallel to a longitudinal axis of the device, the ears limiting inward movement of the attachment members by moving to abut a surface of the post when the strapping is tightened.

13. A mounting device according to claim 12 wherein the ears are swaged to strengthen the ears.

14. A mounting device according to claim 9 wherein the attachment members are slotted to allow the attachment members to be connected to the strapping.

15. A mounting device according to claim 9 wherein the mounting device and the channel are made of materials of different hardness so that one of the abutment portion and the inside of the lips of the channel will bite into the other to thereby enhance the engagement between the channel and the mounting device.

16. A mounting device according to claim 9 wherein the stem portions of the attachment members increase in width towards the abutment portion, thereby providing edges which are adapted to bite into the lips of the channel when the strapping used to attach the mounting device to the post is tightened.

17. A mounting device according to claim 9 wherein a face of the abutment portion is provided with teeth adapted to bite into the channel when the strapping is tightened around the post to thereby enhance the engagement between the mounting device and the channel.

18. A mounting device according to claim 17 wherein the teeth are located towards the ends of the abutment portion.

19. A mounting device according to claim 9 further comprising an insert for increasing the width of the abutment portion, so that the mounting device can be adapted for use in channels of different width.

20. A mounting device according to claim 19 wherein the neck portion is formed as a generally U-shaped channel to provide opposed sides of the channel and the insert is I-shaped to provide enlarged end regions, wherein a narrower central region of the I-shaped insert is adapted to sit between the opposed sides of the U-shaped neck portion and the enlarged end regions of the I-shaped insert are adapted to overlie opposite end regions of the abutment portion, thereby to laterally enlarge the end regions of the abutment portion.

* * * * *